United States Patent [19]

Hite et al.

[11] 4,453,491

[45] Jun. 12, 1984

[54] PACKAGED LUMBER-DIPPING APPARATUS

[75] Inventors: W. Lee Hite; Gary C. Bright, both of Sandy, Oreg.

[73] Assignee: U.S. Metal Works, Inc., Sandy, Oreg.

[21] Appl. No.: 419,082

[22] Filed: Sep. 16, 1982

[51] Int. Cl.[3] ..... B05C 3/09

[52] U.S. Cl. ..... 118/425; 118/429; 118/501; 118/503; 134/164

[58] Field of Search ..... 118/425, 429, 501, 503; 134/164

[56] References Cited

U.S. PATENT DOCUMENTS

| | | | |
|---|---|---|---|
| 1,092,761 | 4/1914 | Tyler | 118/501 X |
| 1,812,291 | 6/1931 | Gosch | 118/425 |
| 1,877,817 | 9/1932 | Cook | 118/425 X |

FOREIGN PATENT DOCUMENTS

| | | | |
|---|---|---|---|
| 2913194 | 10/1980 | Fed. Rep. of Germany | 118/425 |

*Primary Examiner*—John P. McIntosh

*Attorney, Agent, or Firm*—Klarquist, Sparkman, Campbell, Leigh & Whinston

[57] ABSTRACT

A packaged lumber-dipping apparatus comprises a dipping tank of lumber-preserving fluid, a submersible roll case section supported by a hoist mast for lowering a package of lumber into the tank, and infeed and outfeed conveyors. A clamp is mounted on the hoist mast for clamping the package down on the roll case section so that the lumber will not float when submerged in the tank. The infeed conveyor is positioned at an end of the roll case section for feeding a package of lumber lengthwise onto the roll case section. The outfeed conveyor, positioned alongside the tank, receives the package of lumber from the roll case section after dipping. Two tiltable skate roll sections in the roll case section, connected by chains to the clamp, tilt toward the outfeed conveyor when the clamp is raised to unload the package onto the outfeed conveyor after dipping. The roll case section and outfeed conveyor are downwardly inclined lengthwise of the package for draining excess preserving fluid from the lumber back into the tank and into a drip pan underlying the outfeed conveyor, respectively.

14 Claims, 2 Drawing Figures

PACKAGED LUMBER-DIPPING APPARATUS

BACKGROUND OF THE INVENTION

This invention relates generally to the treatment of wood products with preservatives and, more particularly, to apparatus for treating packaged lumber for shipping.

Packaged lumber is conventionally treated with alkaline, penta-type or other liquid preservatives to prevent growth of mildew while enclosed in the hold of a ship. Most commonly, the preserving fluid is sprayed on the packages of lumber just prior to shipping. However, the sprays of most such fluids are highly irritating to humans and do not effectively penetrate the interior of the packages of lumber. A lumber-dipping system has been tried wherein a package of lumber, handled by a lift truck, is placed on a fork lift hoist positioned above a tank full of preserving fluid, chained down, sumbmerged in the tank, lifted out and then removed from the hoist by the lift truck. While this technique improves the penetration of preserving fluid into the package, it is wasteful and does not minimize the exposure of workers to the irritants in the preservative. When the package is removed from the hoist, the preserving fluid drips from the package onto the lift truck and its operator, and onto the ground. The drippings create an irritating and unhealthy working atmosphere for the lift truck and hoist operators. It would be preferable to minimize the amount of preserving fluid wasted and, further, to minimize the exposure of workers to either liquid or airborne preserving fluid, while effectively treating the packages of lumber.

SUMMARY OF THE INVENTION

Accordingly, a primary object of the invention is to thoroughly treat packaged lumber for shipping while minimizing the amount of preserving fluid that is spilled or otherwise lost.

A second object is to minimize the amount of preserving fluid placed into the air.

A further object is to minimize the exposure of workmen to the environment in which preserving fluid is applied to packaged lumber.

Another object is to automate the treatment of packaged lumber for shipment.

In furtherance of these objectives, the invention is a lumber-dipping apparatus comprising a dipping tank, a roll case section, and a hoist mast supporting the roll case section above the tank. The apparatus further includes an infeed conveyor means at an end of the roll case section for infeeding a package of lumber to the roll case section and an outfeed transfer conveyor means for receiving the package of lumber from the roll case after dipping. The hoist includes means for lowering the loaded roll case section into the tank and then raising it from the tank once the lumber has been thoroughly soaked with preserving fluid. Mounted on the hoist mast for vertical movement with the roll case section is a clamping means for clamping the package onto the roll case section so that the packaged lumber will not float when submerged in the tank. The roll case includes a tiltable conveyor means which is pivotable about an end adjacent the outfeed transfer conveyor and tilting means operatively connected to the clamping means for raising the opposite end of the tiltable conveyor means for tilting same to convey the package of lumber from the roll case section onto the outfeed transfer conveyor means. The tilting means can be a linkage means, such as a chain, cable or pull rod, interconnecting the tiltable conveyor means and clamping means. The linkage means is normally slack and the tiltable conveyor means normally rests below level of the rollers of the roll case section for infeeding and dipping a package. Raising the clamping means above a predetermined elevation over the roll case section tightens the linkage means to tilt the tiltable conveyor means toward the outfeed conveyor.

Preferably, the roll case is inclined lengthwise of the lumber to more readily drain fluid from gaps between the lumber and has retractable stops to center packages of lumber of varying lengths on the roll case section. The outfeed transfer conveyor preferably is positioned laterally of the roll case section, is inclined in the same direction as such section, and includes a drip pan for draining excess preserving fluid back to the dip tank. The tiltable conveyor means can thus comprise two or more skate roll sections extending transversely of the roll case section, pivotally connected at one end to the side of such section adjacent the outfeed transfer conveyor means, and connected at their opposite, free ends to the clamping means by the linkage means. The clamping means can include wings extending lengthwise of the roll case section for holding stickers in place atop the package of lumber during dipping. The wing adjacent the infeed conveyor means can be hinged to the clamping means at its proximal end and beveled on the underside of its distal end so that a package of lumber infed horizontally raises the inclined wing upwardly over any stickers atop the package and then, once on the downwardly inclined roll cases section, allows the wing to drop onto the package to hold the stickers in place.

The foregoing and other objects, features and advantages of the invention will become more readily apparent from the following detailed description of a preferred embodiment, which proceeds with reference to the accompanying drawings.

DETAILED DESCRIPTION OF A PREFERRED EMBODIMENT

Figure 1:
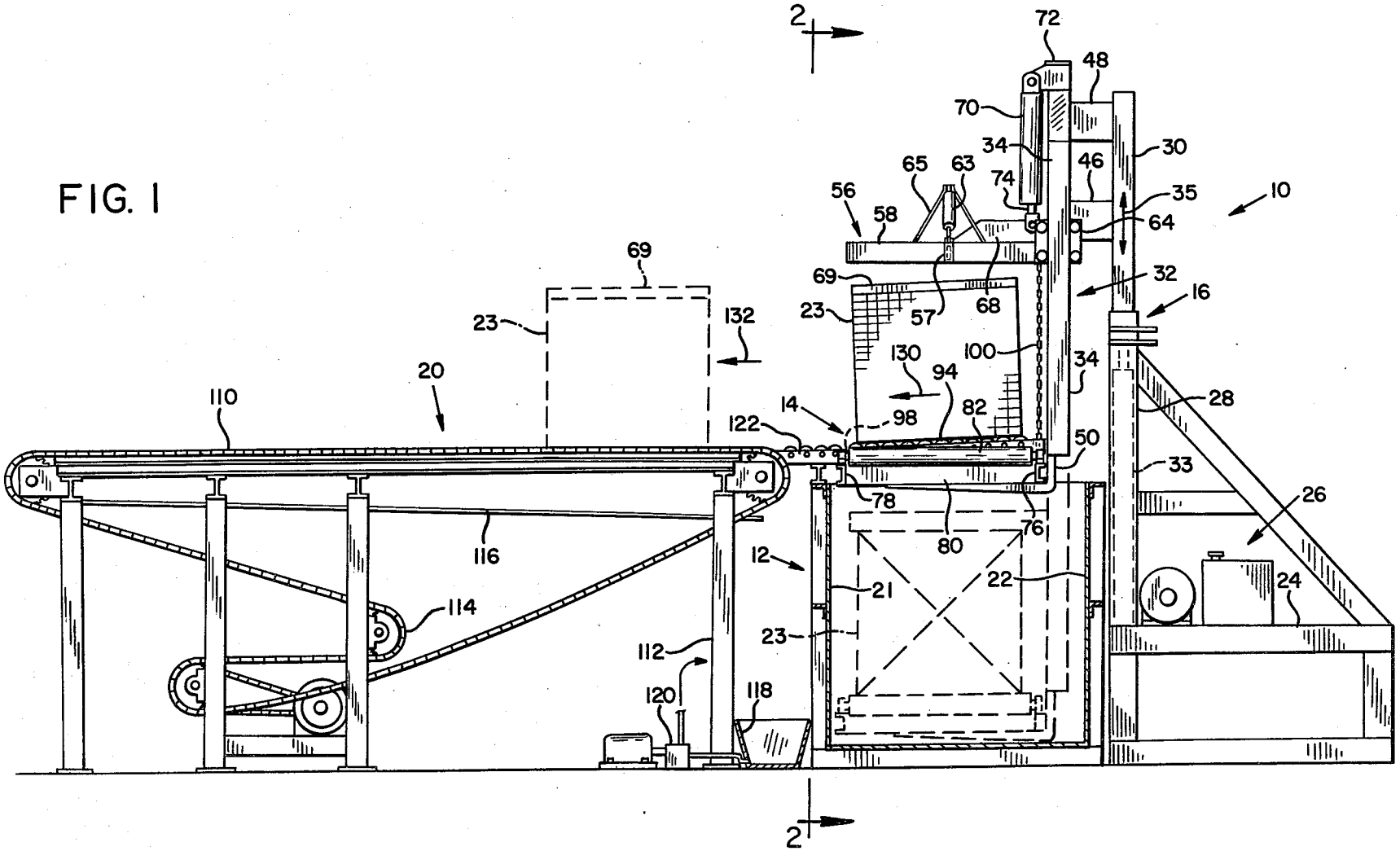
FIG. 1 is a side elevational view of a lumber-dipping apparatus according to the invention, as seen from the infeed conveyor side along lines 1—1 in FIG. 2.

Referring to the drawings, a lumber-dipping apparatus 10 generally comprises an elongated rectangular dipping tank 12, a roll case section 14 extending lengthwise of the tank, a hoist mast 16 supporting the roll case section above the tank, an infeed conveyor 18 at an end of the tank, and an outfeed conveyor 20 alongside the front wall 21 of tank 12.

The infeed conveyor 18 is a conventional horizontal live roll conveyor elevated above the dipping tank and extending lenthwise of the tank to a remote loading location. Packages of lumber 23 are placed lengthwise, one at a time, on the infeed conveyor at such location and the conveyor is driven by conventional drive means (not shown) to infeed each package to the roll case section 14, as indicated by arrow 19.

Dipping tank 12 is sized for completely submerging conventionally-sized packages of lumber in preserving fluid. For example, to dip 4'×4'×20' packages of lumber, the dipping tank suitably has 6.5'×7.0'×23' internal dimensions.

The hoist mast 16 is positioned along rear wall 22 of tank 12. The hoist mast has an upstanding structural steel framework including an elevated base 24 supporting a hydraulic power package 26 and a pair of upright channel members 28, 29 adjacent tank wall 22. A pair of upwardly-extensible channel members 30, 31 nested in members 28, 29 support a fork lift assembly 32 which, in turn, supports roll case section 14. A hydraulic cylinder 33 raises and lowers members 30, 31 and thus assembly 32, as indicated by arrow 35. A hydraulic fluid circuit and manual controls (not shown) provides pressure fluid from power package 126 to cylinder 33 and other cylinders described hereinafter.

The fork lift assembly is a generally rectangular framework comprising a pair of vertical side frame members 34, 36 interconnected by horizontal and diagonal cross frame members 38, 40 and gussets 42. The extensible members 30, 31 are interconnected by cross member 44 to which ram 33 is connected. The fork lift assembly is connected to members 30, 31 via support arms 46, 48, extending horizontally over side 22 of the dipping tank. A pair of L-shaped fork members 50, 52, are received in the lower ends of a pair of vertical box members 51, 53 connected along the inboard sides of frame members 34, 36.

An H-shaped clamp 56 comprising a pair of horizontally-extending parallel channel members 58, 60 interconnected by an I-beam 62 is connected for vertical movement along members 34, 36 by means of a pair of roller assemblies 64, 66. A mounting plate 68, centered between members 58, 60, is connected to I-beam 62. a hydraulic cylinder 70 is connected via mount 72 to cross member 44 above plate 68. The ram 74 of cylinder 70 is connected to plate 68 for raising and lowering clamp 56.

A laterally-extending wing of sticker holder 57, 59 is connected to each side of clamp 56 by means of hinges 61 and hydraulic rams 63 for holding the wings down on stickers 69. Each hydraulic ram is supported by a tripod mount 65 extending upwardly from members 58, 60, 62. The distal end 67 of each sticker holder is inclined upwardly along its lower side, proceeding away from the clamp, to be raised and thereby avoid catching the stickers 69 as a package of lumber moves along the roll case section 14.

Roll case section 14 comprises a pair of elongated parallel channel members 76, 78 interconnected at intervals by transverse I-beams 80. A plurality of free-turning rollers 82 extend transversely of the channel members and are mounted thereon. At the end of the roll case section opposite the infeed conveyor 18 is a fixed stop 84. Spaced along the roll case section from the fixed stop are two adjustable stops 86, 87. The stops are connected via push-pull linkages 88, 89 to the rams of hydraulic cylinders 90, 91 mounted on lift frame member 36 so that the stops can be selectively raised and lowered.

Figure 2:
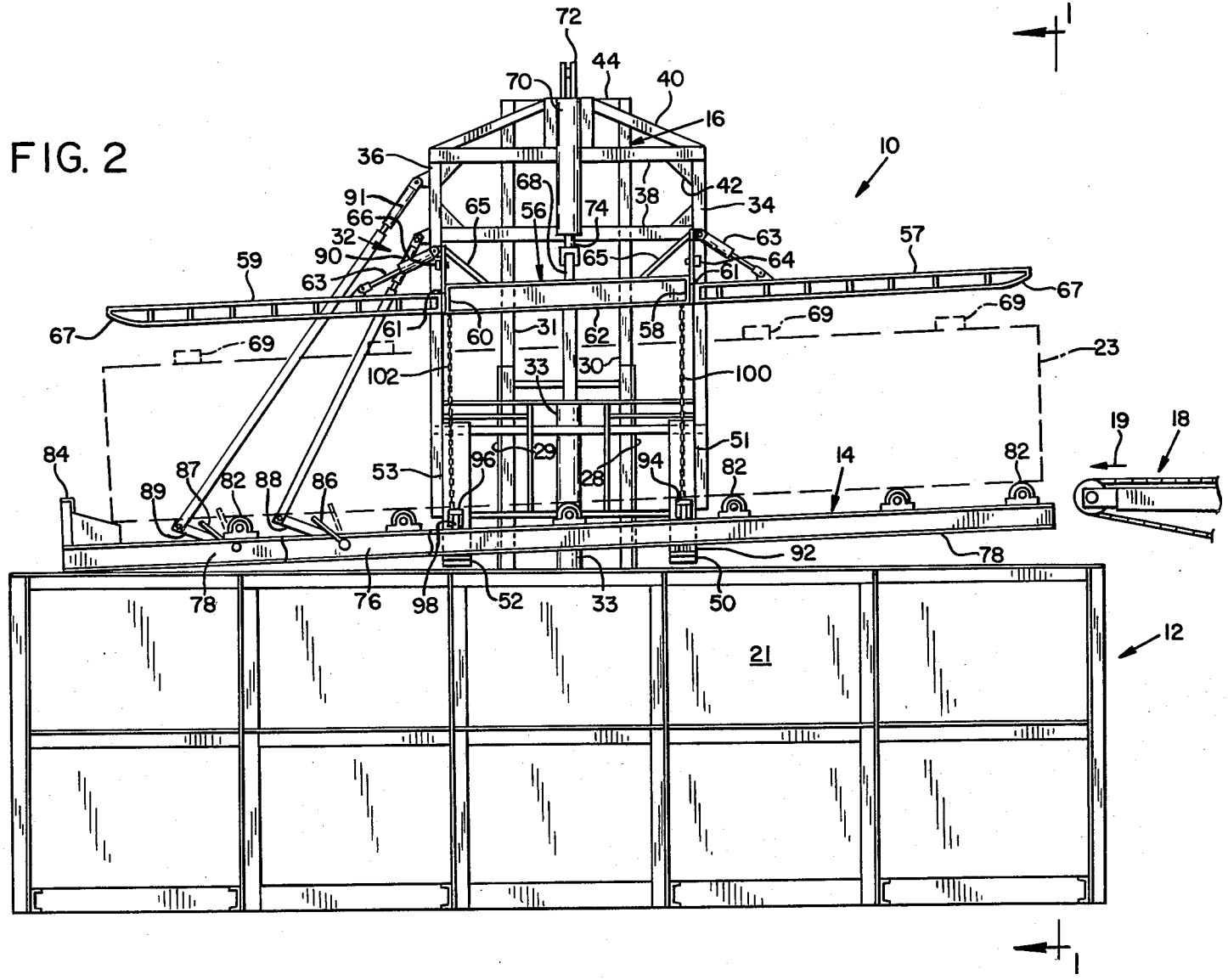
FIG. 2 is a front elevational view taken along lines 2—2 in FIG. 1.

Referring to FIG. 2, roll case section 14 rests directly on fork member 52. It is supported above fork member 50 by a shim 92 sized so that the roll case section is inclined downwardly from the infeed conveyor at about 2°. Clamp 56 and wings 57, 59 are likewise inclined so as to substantially parallel the roll case section.

A pair of skate rolls 94, 96 extend across the roll case section between and normally parallel to the rollers 82 above fork members 50, 52. Each skate roll is pivotally connected at one end to channel member 78 by a hinge 98. The opposite ends of the skate rolls, remote from the outfeed transfer conveyor 20, normally rest freely on channel member 96, but are connected by chains 100, 102 to roller assemblies 64, 66, respectively. These chains have a length such that fully raising the clamp 56 lifts the free ends of the skate rolls above the upper surface of rollers 82 to a 3°–4° downward incline in the direction of the outfeed transfer conveyor to tilt and thereby unload a dipped package of lumber. When the clamp is lowered a short distance, the chain slackens and the skate rolls return to a normal position below the level of rollers 82 for receiving another package of lumber.

Returning to FIG. 1, the outfeed transfer conveyor 20 comprises a transfer chain deck 110 supported on a foundation structure 112. Deck 110 is horizontal in the direction of movement of conveyor 20 but is sloped downwardly from side to side at the same angle as the roll case section 14. The transfer chains are conventionally driven by a chain drive 114. Underlying the transfer deck is a drip pan 116 which slopes downwardly to a return trough or sump 118, positioned between the outfeed transfer conveyor and the dipping tank. A sump pump 120 returns the collected drippings to tank 12. A pair of short, fixed skate roll sections 122, supported on structure 112 and tank sidewall 22, extend above trough 118 in position to transfer packages of lumber from skate rolls 94, 96 onto transfer deck 110. The transfer deck is sized to receive multiple packages of lumber and hold them for a time so that any remaining excess fluid can drain into the drip pan. As additional packages of lumber are added to the outfeed transfer conveyor, earlier-dipped packages are moved toward the end of the conveyor more remote from the drip tank. There, the drained packages are removed by means of either a fork lift truck or an outfeed live roller conveyor (not shown).

OPERATION

The lumber-dipping apparatus 10 can be housed in a separate building to contain the vapors of the preserving fluid. The apparatus is remotely controlled by an operator preferably in an enclosed control room (not shown). This control room is provided with various controls (not shown) for controlling the drives on the infeed conveyor 18, the outfeed conveyor 20, and hydraulic cylinders 30, 63, 70, and 90.

In operation, packages of lumber are placed on infeed conveyor 18 outside the building and conveyor 18 feeds the packages one at a time into the building and onto roll case section 14. Clamp 56 is initially positioned, for receiving a package of lumber 23 on the roll case section, at an elevational above the height of the package of lumber, but low enough that chains 100, 102 are slack and skate rolls 94, 96 are below the level of rollers 82. If a short package of lumber is to be dipped, the ram of hydraulic cylinder 90 is retracted so as to raise stop 86 to center the package on the roll case section. As conveyor 18 moves the package of lumber horizontally onto the roll case section, the end of such package engages the beveled end 67 of wing 57, lifting it over any stickers 69 on the package. As the package shifts from horizontal to the incline of the roll case section 14, the wing is allowed to return to a position parallel to such section.

Once the package is on the roll case section, cylinders 70 and 63 are operated in sequence to clamp the package of lumber on the roll case section and to hold down any stickers resting atop the lumber package. Then, hoist mast cylinder 33 is operated to lower roll case section 14 and the lumber package supported thereon into tank 12, as shown in phantom lines in FIG. 1. Following dipping, cylinder 33 is operated to raise the roll case section and lumber package out of the dipping tank.

Once the roll case section is at the elevation of fixed skate rolls 122, cylinders 63, 70 are actuated to unclamp the lumber package. The ram of cylinder 70 is fully retracted to tension chains 100, 102, thereby raising the free ends of skate rolls 94, 96 above the elevation of rollers 82. As the skate rolls are pivoted upwardly about hinges 98, the lumber package is tilted toward the outfeed transfer conveyor 20 and thereby caused to roll in that direction, as indicated by arrow 130. As the package crosses over the fixed skate rolls 122, the outfeed transfer drive 114 is operated to move the package onto the transfer chain deck 110, as indicated by arrow 132.

The downward slope of the roll case section 14 enables much of the preserving fluid which has seeped between the lumber in the package to drain back into dipping tank 12. The downward inclination of the transfer chain deck 110 likewise enables the continued drainage of any remaining excess preserving fluid from gaps between the lumber in the package. Such fluid drains into the drip pan 116 and is collected in return trough 118. Pump 120 returns the recovered fluid to tank 12. In this way, waste of the fluid is minimized, as is the vaporization from fluid that would otherwise drip on the ground and other surfaces. The dipped and drained packages of lumber are removed from the end of the outfeed conveyor remote from the dipping tank.

Having illustrated and described the principles of our invention in a preferred embodiment, it should be apparent to those skilled in the art that the invention may be modified in arrangement and detail without departing from such principles. We claim as our invention all such modifications as come within the spirit and scope of the following claims.

We claim:

1. A lumber-dipping apparatus comprising:
- a dipping tank of lumber preserving fluid;
- a submersible roll case section;
- a hoist mast supporting the roll case section above the tank and including means for lowering and raising the roll case section into and from the tank;
- infeed conveyor means at an end of the roll case section for feeding a package of lumber onto the roll case section;
- clamping means mounted on the hoist mast for vertical movement with the roll case section for clamping the package onto the roll case section so that the lumber will not float when submerged;
- an outfeed transfer conveyor means for receiving the package of lumber from the roll case section after dipping;
- tiltable conveyor means in the roll case section tiltable toward the outfeed transfer conveyor means; and
- tilting means operatively connected to the clamping means for tilting the tiltable conveyor means to convey the package of lumber from the roll case section onto the outfeed transfer conveyor means after dipping.

2. Apparatus according to claim 1 in which the roll case section is inclined lengthwise of the lumber so that preserving fluid drains from the lumber back into the dipping tank.

3. Apparatus according to claim 2 in which the roll case section includes stop means for stopping said package at a selected position along the section.

4. Apparatus according to claim 2 in which the outfeed conveyor is inclined lengthwise of the lumber and includes means for receiving drippings therefrom and returning same to the dipping tank.

5. Apparatus according to claim 1 in which the clamping means includes sticker holding means extending over the package of lumber on the roll case section for holding a sticker atop the package.

6. Apparatus according to claim 1 in which the roll case section is inclined downwardly from the infeed conveyor means and the clamping means includes sticker holding means comprising a wing extending toward the infeed conveyor means and pivotally connected to the clamping means, the wing having a distal end which is beveled along its underside so that a package of lumber contacting said end raises the wing as the infeed conveyor means moves the package onto the roll case section.

7. Apparatus according to claim 1 in which the outfeed transfer conveyor is positioned laterally of the roll case section and the tiltable conveyor means extends transversely of the roll case section normally below the level of the underside of the package of lumber.

8. Apparatus according to claim 7 in which the tiltable conveyor means has one end pivotally connected to a side of the roll case section adjacent the outfeed conveyor means and a free end connected to the tilting means adjacent the opposite side of the roll case section.

9. Apparatus according to claim 8 in which the tilting means comprises a linkage means interconnecting said free end and said clamping means for elevating said free end when said clamping means is raised above a predetermined elevation above the roll case section.

10. A lumber-dipping apparatus comprising:
- a dipping tank;
- a conveyor means submersible in the tank;
- a hoist means for lowering and raising the submersible conveyor means into and from the tank;
- infeed conveyor means at an end of the submersible conveyor means for feeding a package of lumber lengthwise onto the submersible conveyor means;
- clamping means mounted for vertical movement on the submersible conveyor means for clamping the package onto the conveyor means so that the lumber will not float when submerged;
- an outfeed transfer conveyor means alongside the tank for receiving the package of lumber from the submersible conveyor means after dipping; and
- a drip pan underlying the outfeed transfer conveyor means;
- the submersible conveyor means and outfeed conveyor means being inclined lengthwise of the lumber for draining excess preserving fluid from the lumber into the tank and drip pan, respectively.

11. Apparatus according to claim 10 in which the submersible conveyor means includes adjustable stop means for stopping the package at a selected position along the submersible conveyor means.

12. A lumber-dipping apparatus comprising:
- a dipping tank;
- a submersible conveyor means for receiving and supporting a package of lumber in the tank;

a hoist means for raising and lowering the submersible conveyor means;

a clamping means vertically movable with the submersible conveyor means and relative thereto for clamping the package on the submersible conveyor means; and powered means for raising and lowering the clamping means relative to the submersible conveyor means;

the submersible conveyor means including tiltable conveyor means operatively connected to the clamping means for discharging the package of lumber from the submersible conveyor means when the clamping means is raised.

13. Apparatus according to claim 12 in which the submersible conveyor means is inclined lengthwise of the lumber for draining preserving fluid from the package into the tank.

14. Apparatus according to claim 13 in which the submersible conveyor means includes adjustable stop means for stopping the package at a selected position along the submersible conveyor means.

* * * * *